US006966360B2

(12) United States Patent
Luo et al.

(10) Patent No.: US 6,966,360 B2
(45) Date of Patent: Nov. 22, 2005

(54) HEAT PIPE HAVING AN ELASTIC SEALING MEMBER

(75) Inventors: Chin-Kuang Luo, 5F, No. 56, Min-Chuan Rd., Chung Dist., Taichung City (TW); Chin-Liang Kuo, Ping-Tung (TW)

(73) Assignee: Chin-Kuang Luo, Taichung (TW)

( * ) Notice: Subject to any disclaimer, the term of this patent is extended or adjusted under 35 U.S.C. 154(b) by 0 days.

(21) Appl. No.: 10/683,036

(22) Filed: Oct. 10, 2003

(65) Prior Publication Data

US 2004/0188068 A1 Sep. 30, 2004

(30) Foreign Application Priority Data

Mar. 31, 2003 (TW) ..... 92107300 A

(51) Int. Cl.[7] ..... F28F 15/04
(52) U.S. Cl. ..... 165/104.26; 165/104.21
(58) Field of Search ..... 165/104.21, 104.26; 29/890.032

(56) References Cited

U.S. PATENT DOCUMENTS

| | | | | |
|---|---|---|---|---|
| 4,313,492 A * | 2/1982 | Andros et al. | ..... | 165/104.26 |
| 6,019,165 A * | 2/2000 | Batchelder | ..... | 165/80.3 |
| 2002/0021556 A1 * | 2/2002 | Dibene et al. | ..... | 361/704 |

FOREIGN PATENT DOCUMENTS

| | | | | |
|---|---|---|---|---|
| JP | 56-85691 | * | 7/1981 | ..... 29/890.032 |
| JP | 58-99689 | * | 6/1983 | |
| JP | 59-109781 | * | 6/1984 | |

* cited by examiner

*Primary Examiner*—Teresa J. Walberg
(74) *Attorney, Agent, or Firm*—Trop, Pruner & Hu, P.C.

(57) ABSTRACT

A heat pipe includes a hollow body having a fluid filling end which is covered with an elastic sealing member. The sealing member is pierced with a needle by extending the needle through the sealing member and into the hollow body. Air is drawn out from within the hollow body through the needle and a heat transfer fluid is introduced into the hollow body through the needle. The sealing member provides a passage for the needle when the sealing member is pierced and contracts to seal the passage after the needle is removed from the sealing member.

7 Claims, 10 Drawing Sheets

HEAT PIPE HAVING AN ELASTIC SEALING MEMBER

CROSS-REFERENCE TO RELATED APPLICATION

This application claims priority of Taiwanese Application No. 092107300, filed on Mar. 31, 2003.

BACKGROUND OF THE INVENTION

1. Field of the Invention

The invention relates to a heat pipe, more particularly to a heat pipe having an elastic sealing member and to the method for producing the same.

2. Description of the Related Art

Referring to FIGS. 1 to 4, a method for producing a conventional heat pipe 1 includes the steps of providing a metallic hollow body 11 with an open end portion 111 and an inner chamber, pouring a suitable amount of heat transfer liquid into the hollow body 11, and evacuating and sealing the hollow body 11. The sealing process of the conventional heat pipe 1 includes the following steps:

(A) Pinching the open end portion 111 of the hollow body 11 by means of a machine tool 2 so as to close the open end portion 111 and so as to form a flattened sealing portion 112;

(B) Cutting a top end portion 1121 of the flattened sealing portion 112 by means of a cutting machine 3; and (C) Sealing the heat pipe 1 by a spot welding process.

However, in actual use, the aforementioned flattened sealing portion 112 of the heat pipe 1 is easily broken due to an external force, thereby resulting in leakage of the heat pipe 1. Furthermore, the flattened sealing portion 112 increases the length of the heat pipe 1 so that the latter has a relatively large volume. Moreover, since the liquid is first poured into the hollow body 11 followed by the evacuation process, it is possible that some of the liquid will be drawn out such that the quantity of the liquid in the hollow body 11 and the quality of the heat pipe 1 cannot be accurately controlled. Additionally, the method for producing the conventional heat pipe 1 is somewhat complicated.

SUMMARY OF THE INVENTION

Therefore, the object of the present invention is to provide a heat pipe having an elastic sealing member and to the method for producing the heat pipe in order to overcome the aforementioned drawbacks of the prior art.

According to one aspect of this invention, a method for producing a heat pipe comprises the steps of: providing a hollow body having a fluid filling end; covering the fluid filling end of the hollow body with an elastic sealing member; piercing the elastic sealing member with a needle; extending the needle through the elastic sealing member and into the hollow body; drawing out air from within the hollow body through the needle; and introducing a heat transfer fluid into the hollow body through the needle. The elastic sealing member provides a passage for the needle when the elastic sealing member is pierced, and contracts to seal the passage after the needle is removed from the elastic sealing member.

According to another aspect of this invention, a heat pipe comprises a hollow body having a fluid filling end provided with a needle hole, an elastic sealing member covering the needle hole, and a heat transfer fluid provided in the hollow body. The elastic sealing member is pierceable to provide a passage, and is contractible to seal the passage.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
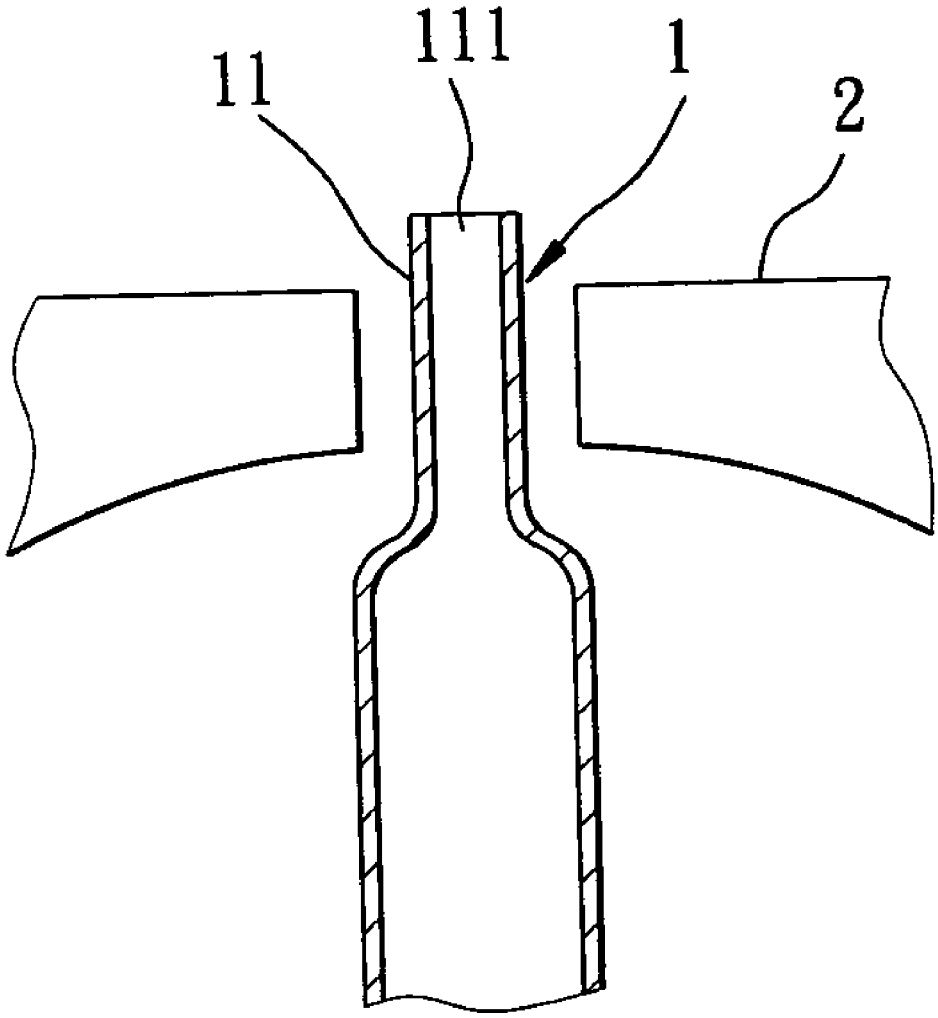
FIG. 1 PRIOR ART
FIG. 1 is a fragmentary sectional view of a conventional heat pipe prior to pinching of an open end portion by a machine tool.
Figure 2:
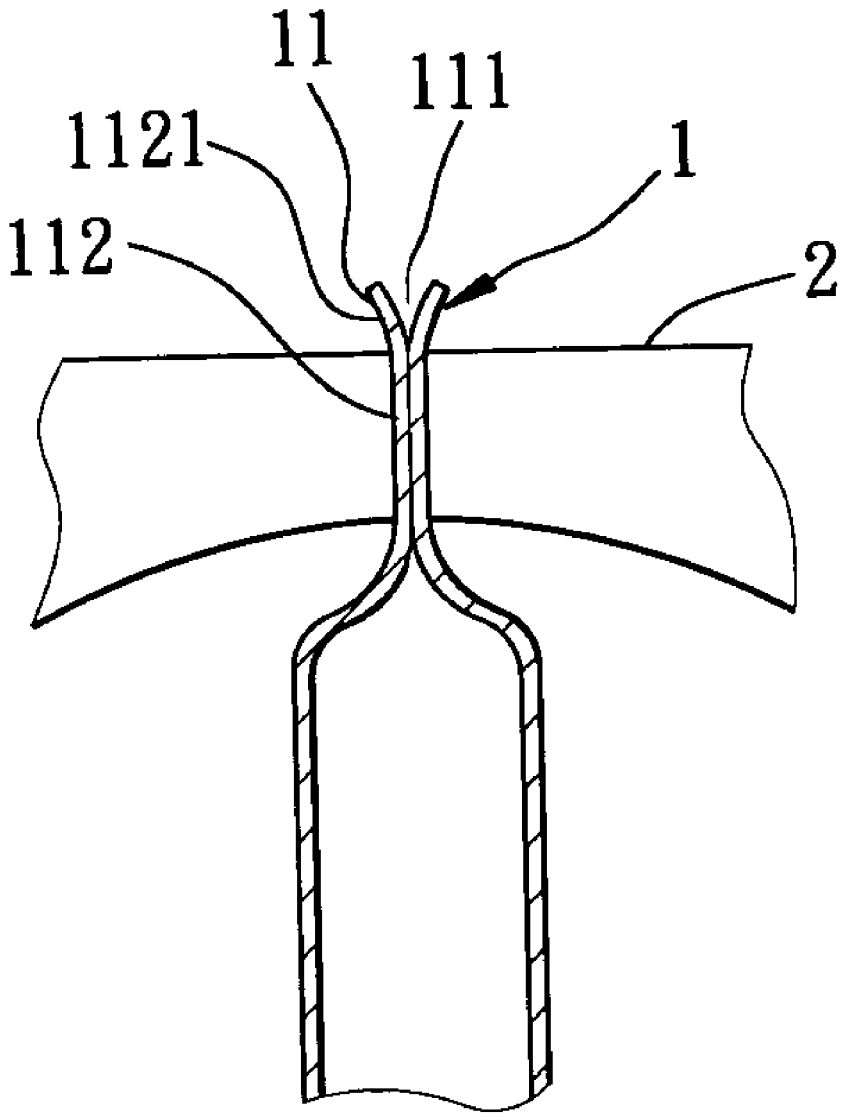
FIG. 2 PRIOR ART
FIG. 2 is another fragmentary sectional view of the conventional heat pipe, illustrating the pinching of the open end portion of the heat pipe by the machine tool to form a flattened sealing portion.
Figure 3:
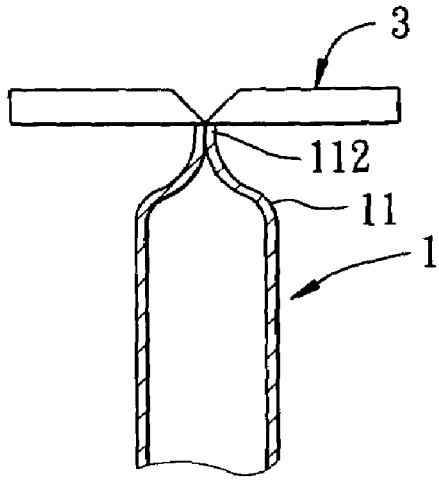
FIG. 3 PRIOR ART
FIG. 3 is yet another fragmentary sectional view of the conventional heat pipe, illustrating a top end portion of the flattened sealing portion which has been cut by a cutting machine.
Figure 4:
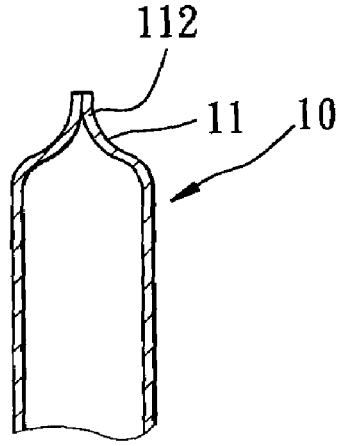
FIG. 4 PRIOR ART
FIG. 4 is a further fragmentary sectional view of the conventional heat pipe, illustrating that the heat pipe has been sealed by a spot welding process.

Before the present invention is described in greater detail, it should be noted that like elements are denoted by the same reference numerals throughout the disclosure.

Figure 5:
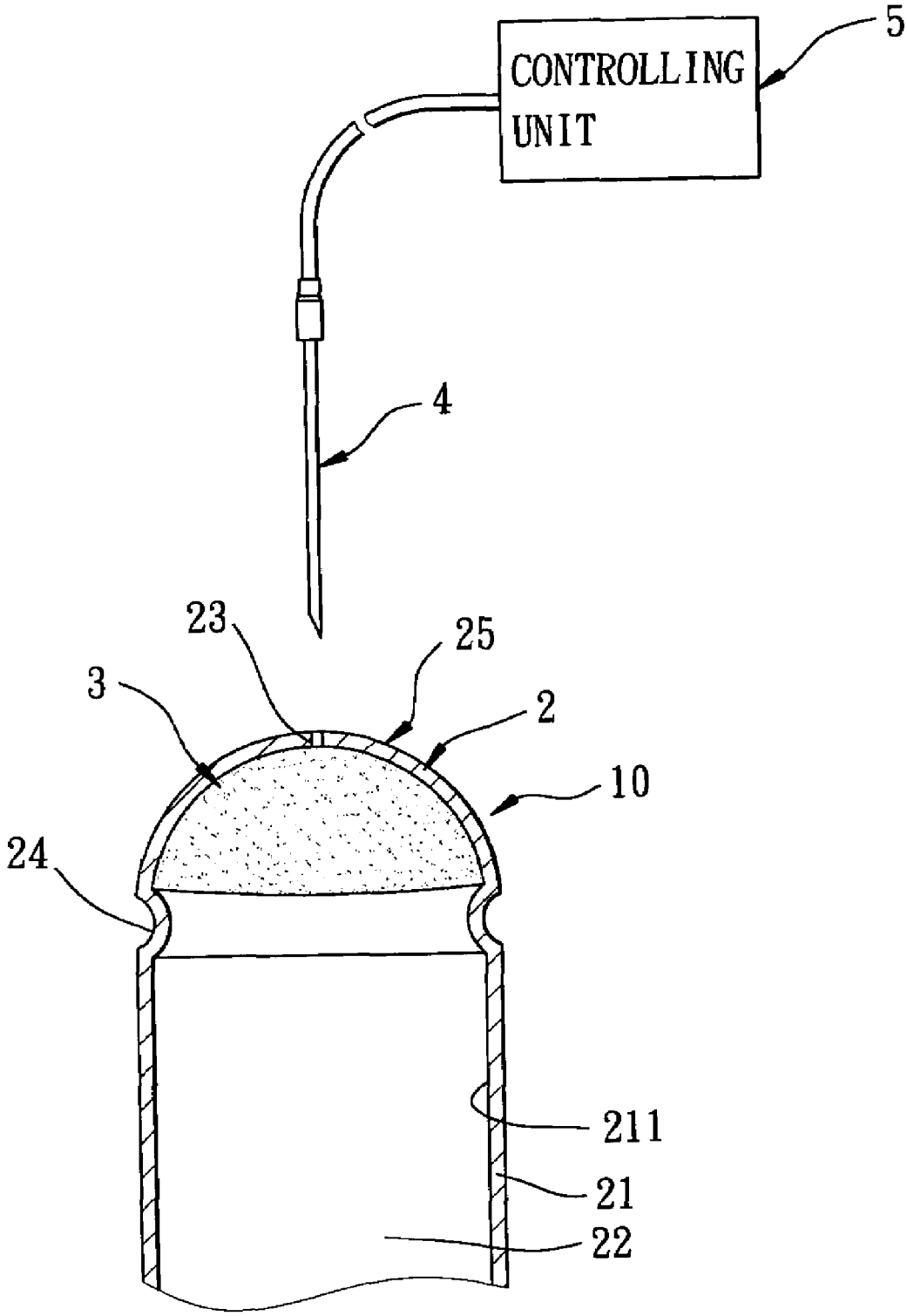
FIG. 5 is a fragmentary sectional view of the first preferred embodiment of a heat pipe according to the present invention.
Figure 6:
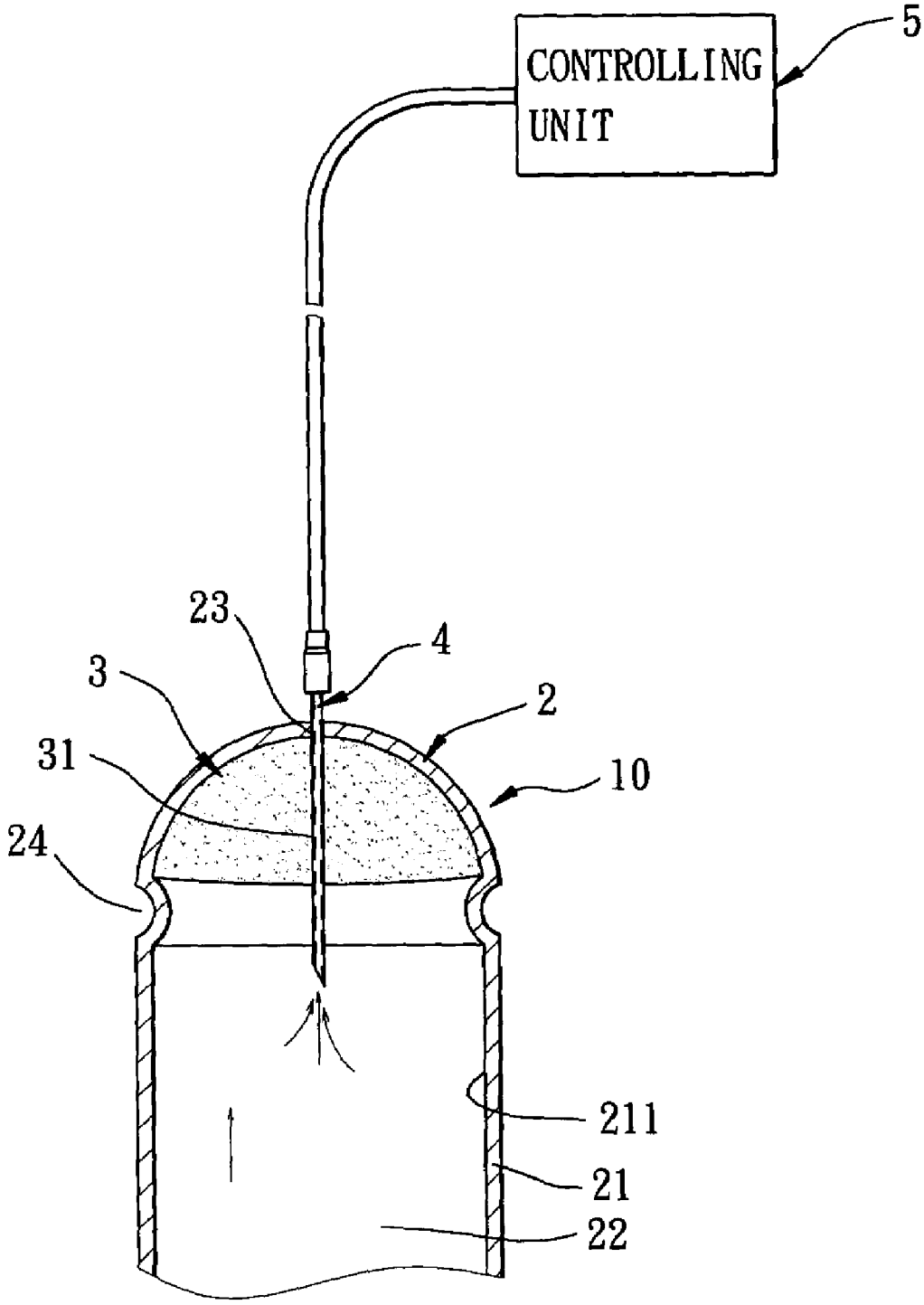
FIG. 6 is a fragmentary sectional view to illustrate how a needle that is connected to a controlling unit draws out air from within a tubular body of the heat pipe of the first preferred embodiment.
Figure 7:
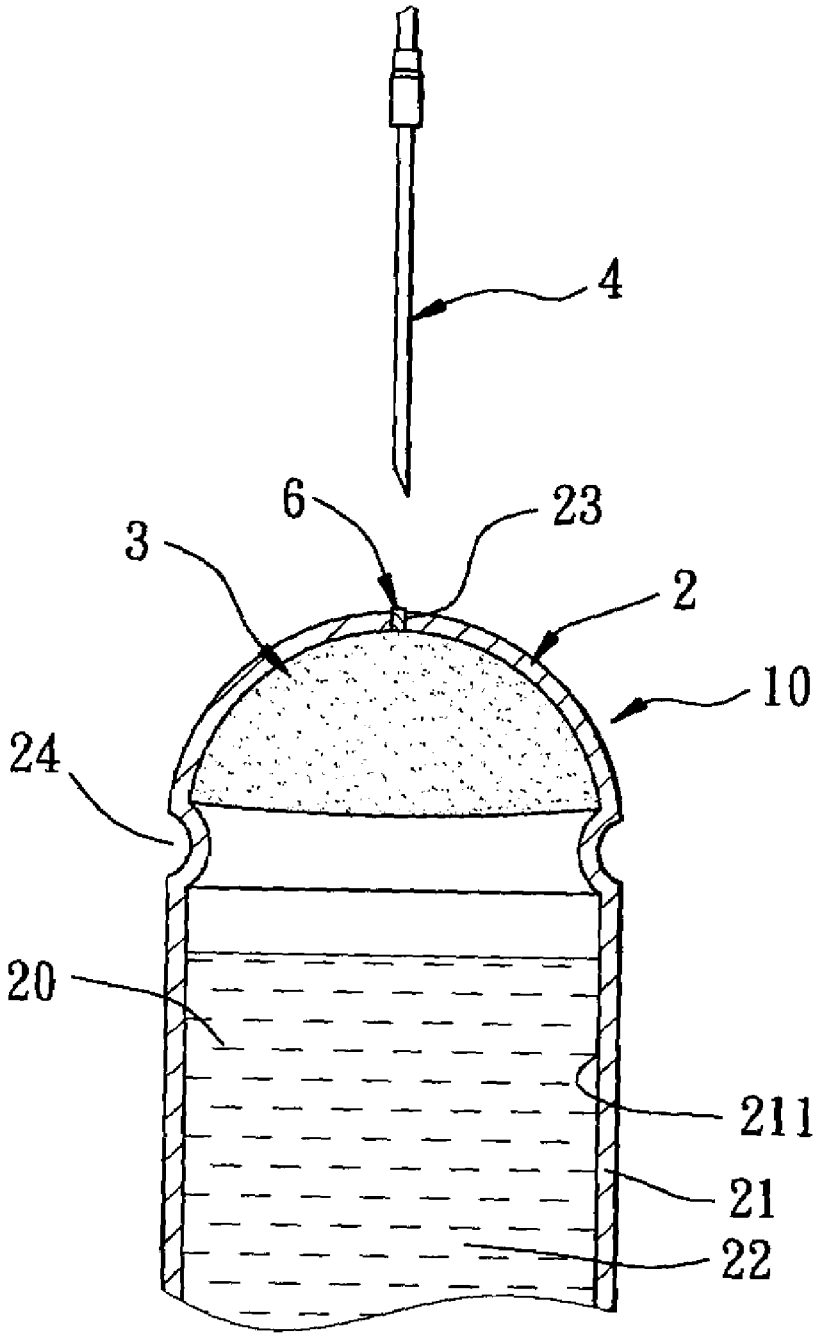
FIG. 7 is a fragmentary sectional view to illustrate the tubular body of the heat pipe of the first preferred embodiment when sealed.

Referring to FIGS. 5, 6 and 7, the first preferred embodiment of a heat pipe 10 according to the present invention is shown to comprise a hollow or tubular body 2, an elastic sealing member 3, and a suitable amount of a heat transfer fluid 20 provided in the tubular body 2.

The tubular body 2 has a peripheral wall 21 with an inner surface 211 defining an inner chamber 22, a fluid filling end 25 formed as a converging end, which defines a needle hole 23, and a constricted part 24 extending around the tubular body 2 and disposed near but spaced apart from the converging end. The needle hole 23 is in fluid communication with the inner chamber 22.

The elastic sealing member 3 covers the needle hole 23 in the fluid filling end 25 of the tubular body 2, and is made of an elastic material, such as a rubber or a silicone elastomer. In this embodiment, the elastic sealing member 3 is provided by introducing a curable resin into the tubular body 2 through the needle hole 23. After the resin is cured, the sealing member 3 is formed and retained sealingly between the converging end and the constricted part 24 of the tubular body 2. The sealing member 3 is pierceable to provide a passage 31 (see FIG. 6), and is contractible to seal the passage 31. It should be noted that the sealing member 3 adheres more sealingly to the inner surface 211 of the tubular body 2 due to the presence of the constricted part 24 of the tubular body 2.

To fill the tubular body 2 with the heat transfer fluid 20, a needle 4 is inserted into the inner chamber 22 of the tubular body 2 by passing through the needle hole 23 and piercing through the sealing member 3. The needle 4 is connected to a controlling unit 5, which operates to subsequently evacuate air from within the inner chamber 22 and to introduce a predetermined amount of the heat transfer fluid 20 (see FIG. 7) into the inner chamber 22. Since the operating principle of the controlling unit 5 is known in the art, and is not pertinent to the claimed invention, a detailed description of the same will be dispensed with herein for the sake of brevity. When the needle 4 is withdrawn from the tubular body 2, the sealing member 3, because of its elasticity, contracts to seal the passage 31, and the needle hole 23 is finally closed by a welding process so that air cannot enter the inner chamber 22 of the tubular body 2.

Unlike the aforementioned conventional heat pipe 1, the heat pipe 10 of the present invention does not have to undergo the processes of pinching and cutting prior to sealing. Furthermore, the heat pipe 10 of the present invention has an outer appearance that is not easily broken by an external force, and a length that is shorter than that of the conventional heat pipe 1 so that it does not occupy a relatively large space. Moreover, the amount of the heat transfer fluid 20 filled in the tubular body 2 can be controlled accurately using simple processing equipment so that working quality of the heat pipe 10 of the present invention can be effectively ensured.

It should be further noted that when the needle 4 is withdrawn from the sealing member 3, the needle hole 23 in the tubular body 2 can be closed by a spot welding process or by a solder pot process to effect better airtight sealing. A welding spot, represented by numeral 6, is shown in FIG. 7.

Figure 8:
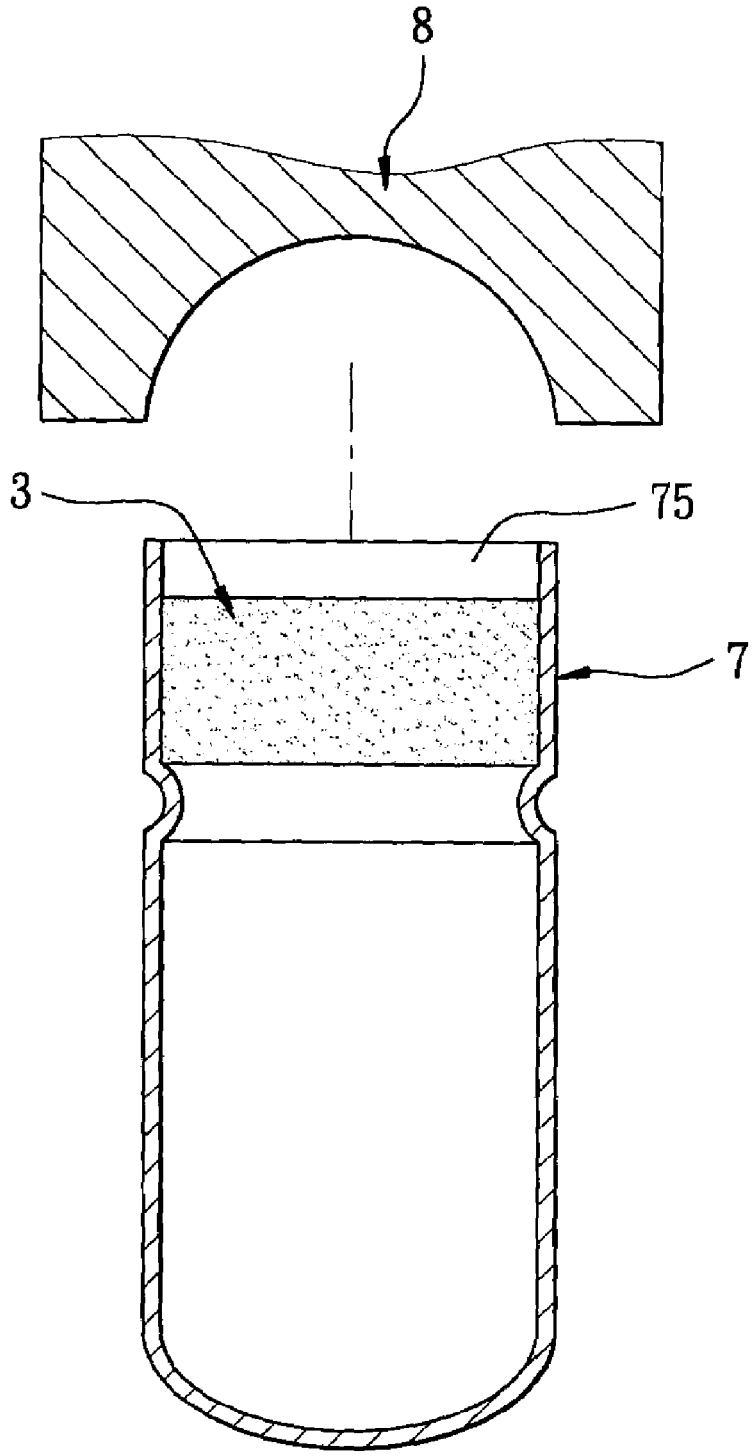
FIG. 8 is a sectional view to illustrate how the second preferred embodiment of a heat pipe according to the present invention is produced.
Figure 9:
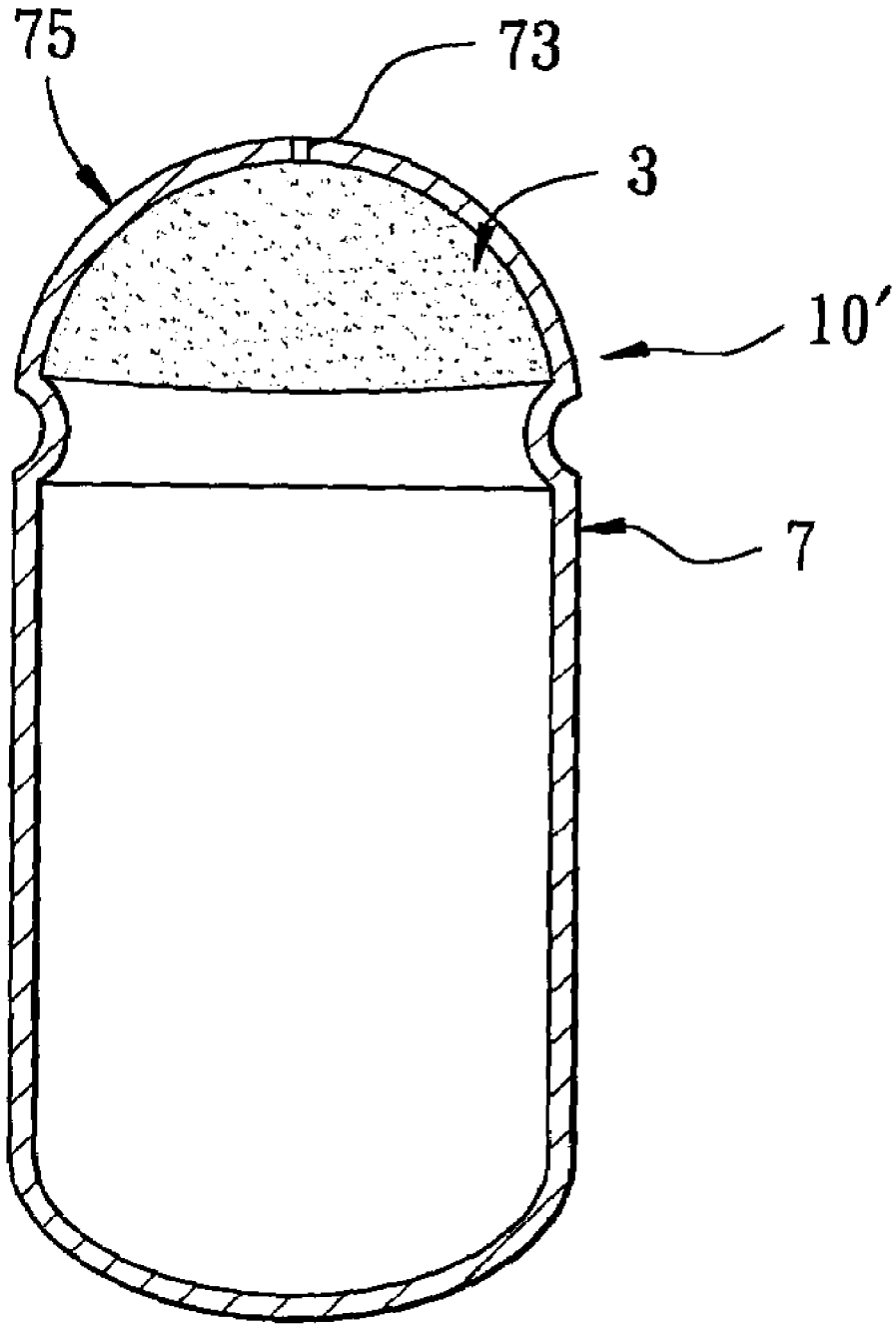
FIG. 9 is a sectional view to illustrate the tubular body of FIG. 8 when sealed.

Referring to FIGS. 8 and 9, the second preferred embodiment of the heat pipe 10' according to the present invention is shown to be substantially similar to the first preferred embodiment. However, in this embodiment, the elastic sealing member 3 is a cured sealing block which is fitted within a fluid filling end 75 of a hollow or tubular body 7 before the fluid filling end 75 is contracted by a pipe contracting machine 8 to form the converging end, which defines the needle hole 73.

Figure 10:
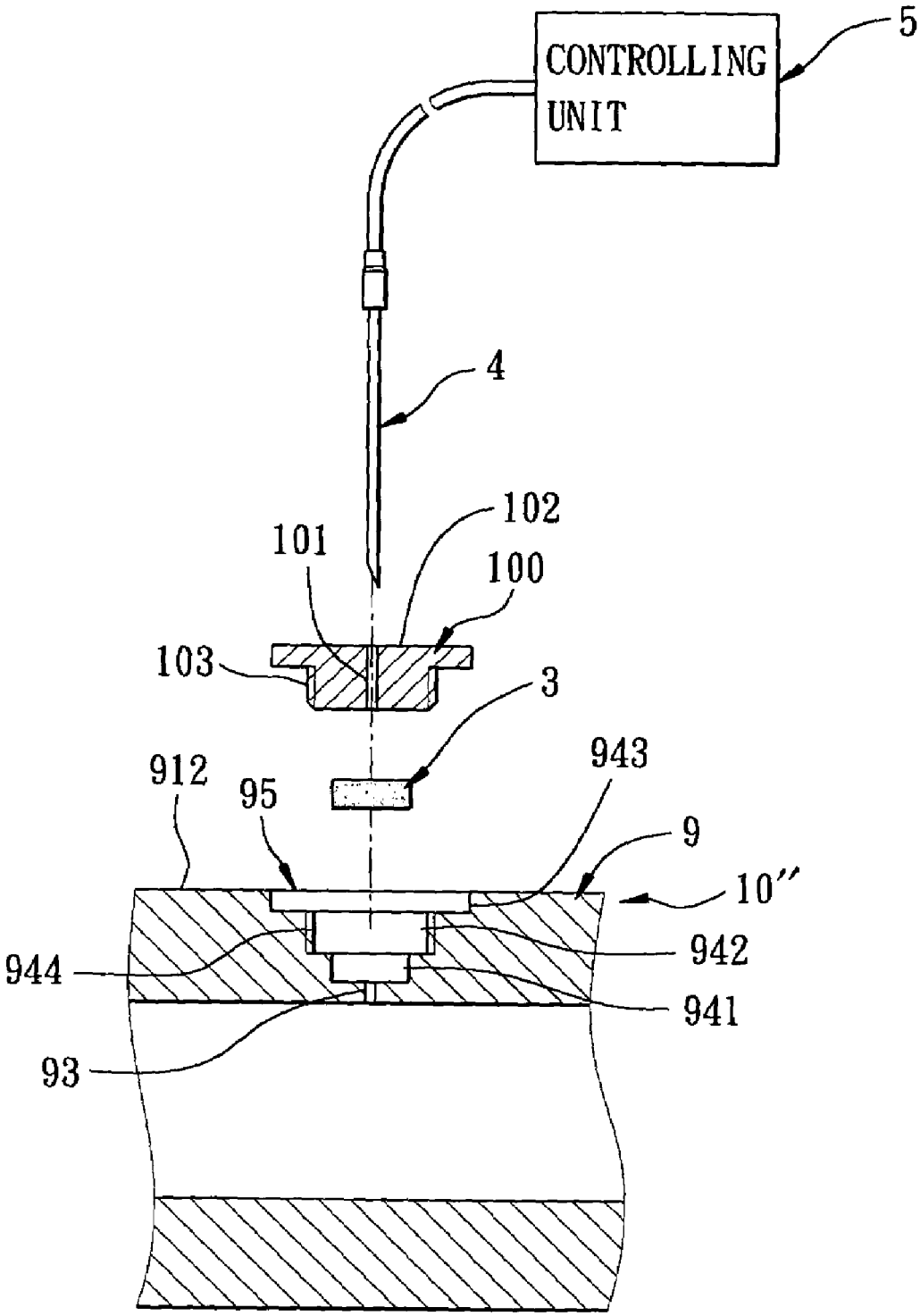
FIG. 10 is a fragmentary sectional view of the third preferred embodiment of a heat pipe according to the present invention.
Figure 11:
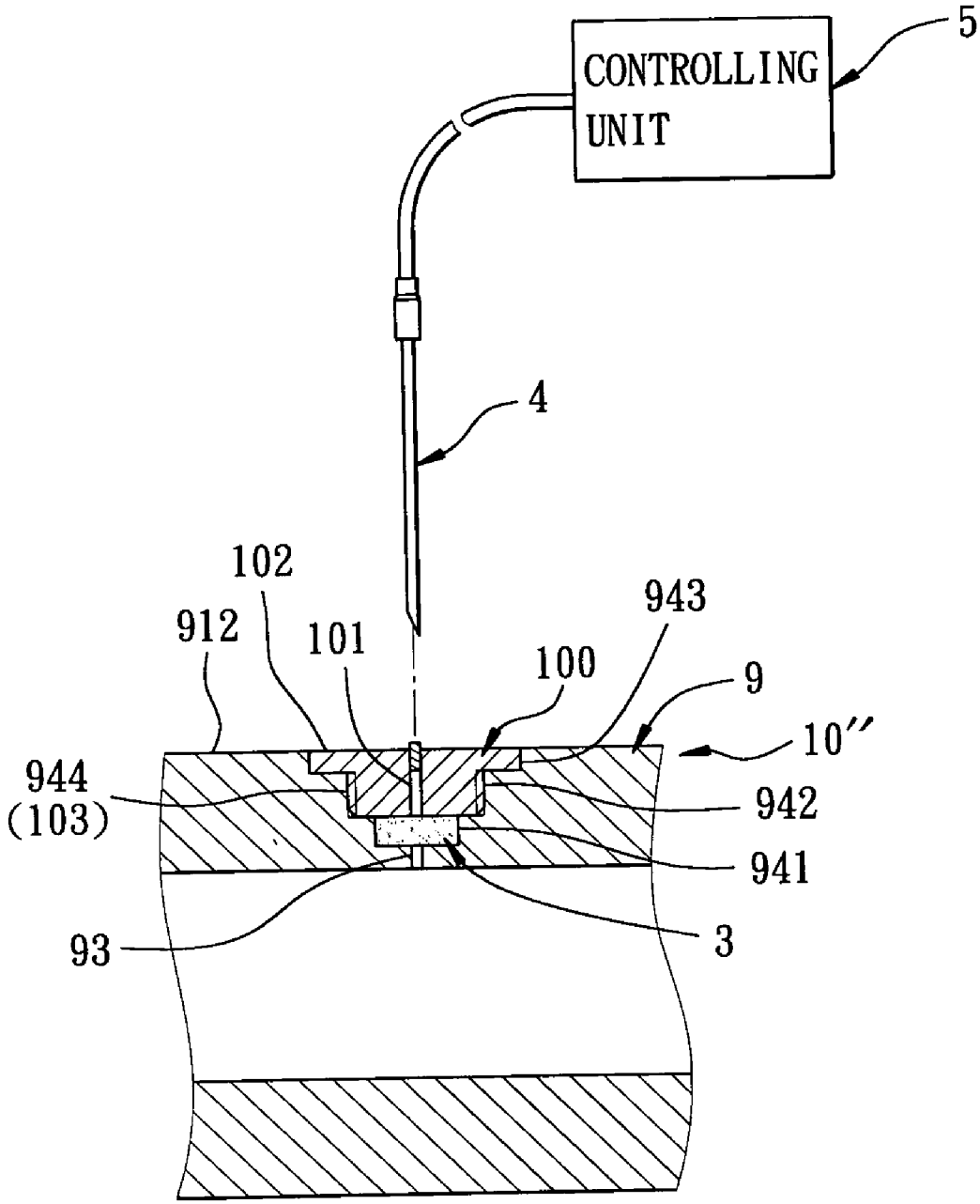
FIG. 11 is a fragmentary sectional view of the third preferred embodiment, illustrating a hollow body of the heat pipe of FIG. 10 when sealed.

Referring to FIGS. 10 and 11, the third preferred embodiment of the heat pipe 10" according to the present invention is shown to be substantially similar to the first preferred embodiment. The heat pipe 10" is suitable for use in an electronic device, such as a computer. In this embodiment, the heat pipe 10" further comprises a positioning member 100 to press the elastic sealing member 3 against the needle hole 93. The hollow body 9 is in the form of a hollow panel, and includes a planar top surface 912 formed with a fluid filling end 95. The fluid filling end 95 includes a receiving hole 941 and a positioning hole 942. The receiving hole 941 is disposed outwardly of and is communicated with the needle hole 93 to receive fittingly the elastic sealing member 3 therein, and has a cross-section greater than that of the needle hole 93. The positioning hole 942 is disposed outwardly of and is communicated with the receiving hole 941 to receive the positioning member 100 therein, and has a cross-section greater than that of the receiving hole 941. The positioning hole 942 includes an enlarged part 943, and a threaded part 944 opposite to the enlarged part 943. In this embodiment, the positioning member 100 has a flanged end part 102, and an externally threaded part 103 that is opposite to the flanged end part 102 and that is connected threadedly to the threaded part 944 of the positioning hole 942 when the positioning member 100 is mounted in the positioning hole 942. A processing machine tool (not shown) can be used alternatively to press fit the positioning member 100 into the positioning hole 942. The positioning member 100 further has a through hole 101 for extension of the needle 4 therethrough.

After the positioning member 100 is engaged threadedly to the positioning hole 942 in the hollow body 9, the positioning member 100 presses against the sealing member 3 so that the sealing member 3 is fitted tightly within the receiving hole 941. At this time, the flanged end part 102 of the positioning member 100 is flush with the top surface 912 of the hollow body 9. Finally, the throughhole 101 in the positioning member 100 is sealed.

Therefore, the method for producing the heat pipe 10 of the present invention includes the following steps.

First of all, the hollow body 2 having the fluid filling end 25 is provided. Thereafter, the fluid filling end 25 of the hollow body 2 is contracted to form the converging end, which defines the needle hole 23. The hollow body 2 is also provided with the constricted part 24 that extends around the hollow body 2 near but spaced-apart from the converging end.

Afterwards, the fluid filling end 25 of the hollow body 2 is covered with the elastic sealing member 2. The sealing member 3 is provided by introducing a curable resin into the hollow body 2 through the needle hole 23, and by curing and forming the curable resin between the converging end and the constricted part 24. Alternatively, the elastic sealing member 3 can be a cured sealing block that is first fitted within the fluid filling end 75 of the hollow body 7, after which the fluid filling end 75 is contracted to form the converging end that defines the needle hole 73. The constricted part 24 of the hollow body 2 pushes the sealing member 3 to abut sealingly against an inner surface of the hollow body 2.

Then, the elastic sealing member 3 is pierced with the needle 4, which extends through the sealing member 3 and into the hollow body 2.

Subsequently, air is drawn out from within the hollow body 2 through the needle 4, and a predetermined amount of the heat transfer fluid 20 is introduced into the hollow body 2 through the needle 4. Then, the needle 4 is withdrawn from the sealing member 3, and the sealing member 3 contracts to seal the passage 31. Afterwards, the needle hole 23 in the hollow body 2 is closed by a spot welding process or by a solder pot process to effect better airtight sealing of the heat pipe 10.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A heat pipe comprising:

a hollow body having a fluid filling end provided with a needle hole;

an elastic sealing member covering said needle hole; and a heat transfer fluid provided in said hollow body;

wherein said elastic sealing member is pierceable to provide a passage and is contractible to seal said passage; and wherein said fluid filling end of said hollow body is formed as a converging end, which defines said needle hole, said hollow body further including a constricted part extending around said hollow body near said converging end but spaced apart from said converging end, wherein said elastic sealing member is retained between said converging end and said constricted part.

2. The heat pipe as claimed in claim 1, wherein said elastic sealing member is provided by introducing a curable resin into said hollow body through said needle hole, and by curing and forming said curable resin between said converging end and said constricted part.

3. The heat pipe as claimed in claim 2, wherein said needle hole is closed by a welding process.

4. The heat pipe as claimed in claim 3, wherein said needle hole is closed by a spot welding process.

5. The heat pipe as claimed in claim 3, wherein said needle hole is closed by a solder pot process.

6. The heat pipe as claimed in claim 1, wherein said sealing member is a cured sealing block which is fitted within said fluid filling end before said fluid filling end is contracted to form said converging end.

7. A heat pipe comprising:

a hollow body having a fluid filling end provided with a needle hole;

an elastic sealing member covering said needle hole;

a heat transfer fluid provided in said hollow body;

wherein said elastic sealing member is pierceable to provide a passage and is contractible to seal said passage; and a positioning member to press said elastic sealing member against said needle hole, wherein said fluid filling end further includes a positioning hole which is disposed outwardly of and which is communicated with said receiving hole to receive said positioning member and which is greater in cross-section than that of said receiving hole, wherein said fluid filling end further includes a receiving hole which is disposed outwardly of and which is communicated with said needle hole to receive fittingly said elastic sealing member and which is greater in cross-section than that of said needle hole.

* * * * *